US006846155B2

(12) United States Patent
Takami et al.

(10) Patent No.: US 6,846,155 B2
(45) Date of Patent: Jan. 25, 2005

(54) FUEL PUMP

(75) Inventors: Yoshihiro Takami, Obu (JP); Kenzo Nagasaka, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/324,852

(22) Filed: Dec. 20, 2002

(65) Prior Publication Data

US 2003/0118437 A1 Jun. 26, 2003

(30) Foreign Application Priority Data

Dec. 25, 2001 (JP) ..... 2001-391627

(51) Int. Cl.[7] ..... F04D 5/00
(52) U.S. Cl. ..... 415/55.1; 416/223 R
(58) Field of Search ..... 415/55.1, 55.2, 415/55.3, 55.4, 55.5, 55.6, 55.7; 416/189, 223 R, 243

(56) References Cited

U.S. PATENT DOCUMENTS 5,807,068 A * 9/1998 Dobler et al. ..... 415/55.1
6,113,363 A * 9/2000 Talaski ..... 415/55.1
6,638,009 B2 * 10/2003 Honma ..... 415/55.1
2003/0118438 A1 * 6/2003 Usui et al. ..... 415/55.1

FOREIGN PATENT DOCUMENTS

| | | |
|---|---|---|
| DE | 19504079 A1 | 8/1996 |
| DE | 10220643 A1 | 12/2002 |
| EP | 1158172 A1 | 11/2001 |
| JP | 9511812 | 11/1997 |

OTHER PUBLICATIONS

*As translated in WO 96/24769 (abstract) and by Japan Patent Office via computer (claims and specification).

* cited by examiner

*Primary Examiner*—Edward K. Look
*Assistant Examiner*—Richard A. Edgar
(74) *Attorney, Agent, or Firm*—Baker Botts LLP

(57) ABSTRACT

A fuel pump improved in pump efficiency is provided. An impeller rotating in a pump casing has an approximately disk-shaped configuration with a group of recesses formed in a region extending along the outer peripheries of the obverse and reverse sides of the impeller. The recesses are repeatedly arranged in the circumferential direction at a distance between each pair of adjacent recesses. The radially outer end face of each recess slantingly extends radially outward from a middle plane in the direction of thickness toward the obverse and reverse sides. With this fuel pump, the incidence of separation or vortex formation in the flow of fuel is minimized, and a high pump efficiency can be obtained.

14 Claims, 5 Drawing Sheets

FUEL PUMP

BACKGROUND OF THE INVENTION

1. Field of the Invention

The present invention relates to a fuel pump adapted to suck in and pressurize a fuel such as gasoline and discharge the pressurized fuel.

2. Discussion of Related Art

There is known a fuel pump adapted to suck in and discharge a fuel by rotating an impeller in a pump casing. An example of this type of fuel pump is disclosed in Published Japanese Translation of PCT International Publication No. Hei 9-511812. The impeller rotating in the pump casing has an approximately disk-shaped configuration. A group of recesses are formed in a region extending along the outer peripheries of the obverse and reverse sides of the disk-shaped impeller. The recesses are repeatedly arranged in the circumferential direction with a partition provided between each pair of adjacent recesses. The radially outer end face of each recess extends parallel to the axis of rotational symmetry of the impeller. The impeller is rotated at high speed about the axis by a motor.

The lifetime of fuel pumps is mostly determined by the progression of wear between the commutator and brush of the motor. The wear progression rate is closely related to the motor current value. That is, the smaller the motor current, the lower the wear progression rate. For this reason, there is a demand that the lifetime of fuel pumps should be extended by increasing the pump efficiency and reducing the motor current to thereby lower the wear progression rate.

With the technique disclosed in the above-mentioned Publication No. Hei 9-511812, the partition for separating each pair of adjacent recesses is inclined rearward in the direction of rotation as the distance from the obverse and reverse sides of the impeller increases inward in the direction of thickness of the impeller, thereby increasing the pump efficiency.

SUMMARY OF THE INVENTION

The pump efficiency can be increased by the technique disclosed in Published Japanese Translation of PCT International Publication No. Hei 9-511812. However, the radially outer end faces of the recesses extend parallel to the axis of rotational symmetry of the impeller. Therefore, the fuel flowing toward the radially outer end faces of the recesses is likely to separate or form vortex. Thus, there is still some room for improvement of the pump efficiency.

Accordingly, an object of the present invention is to further improve the pump efficiency.

The fuel pump created by the present invention is characterized in that an impeller rotating in a pump casing has an approximately disk-shaped configuration with a group of recesses formed in a region extending along the outer peripheries of the obverse and reverse sides of the impeller. The recesses are repeatedly arranged in the circumferential direction with a partition provided between each pair of adjacent recesses. The radially outer end face of each recess slantingly extends radially outward from a middle plane in the direction of thickness toward the obverse and reverse sides.

With this fuel pump, the incidence of separation or vortex formation in the flow of fuel is minimized, and a high pump efficiency can be obtained.

When the diameter of the impeller is from 22 to 28 mm, it is preferable that the radial length of each partition should be from 2.9 to 4.0 mm, and the circumferential distance between each pair of adjacent partitions should be from 1.0 to 2.0 mm, and further the thickness of each partition should be from 0.2 to 1.5 mm, and further the thickness of the impeller should be from 3.0 to 4.5 mm, and further the radially outer end face of each recess should slantingly extend at an open angle of not more than 20° from the middle plane in the direction of thickness. Alternatively, it is preferable that the radially outer end face of each recess should have two arcuate surfaces contacting each other at the middle plane in the direction of thickness. In this case, it is preferable that the radius of the arcuate surfaces should be from 0.7 to 1.8 mm.

It is preferable that the fuel pump should have the following features (a) to (d1) in addition to the feature that the radially outer end face of each recess slantingly extends radially outward from the middle plane in the direction of thickness toward the obverse and reverse sides:ps (a) The radially inner and outer end portions of each partition are positioned on the same radius, and the radially middle portion of the partition is curved rearward in the direction of rotation of the impeller.

(a1) The maximum amount of curvature of the partition is from 0.1 to 1.0 mm.

(b) The partition is inclined rearward in the direction of rotation as the distance from the obverse and reverse sides increases inward in the direction of thickness.

(b1) The partition is inclined at from 35° to 55° from the middle plane in the direction of thickness.

(b2) The partition continuously extends while defining a gently arcuate surface at the rotation direction forward side of the middle plane in the direction of thickness.

(c) The thickness of the partition increases as the distance from the obverse and reverse sides increases inward in the direction of thickness.

(c1) The thickness of the partition at the middle plane in the direction of thickness is greater than the thickness at the obverse and reverse sides by from 0.1 to 0.4 mm.

(d) The radially inner end face of a recess located between each pair of adjacent partitions has two arcuate surfaces contacting each other at the middle plane in the direction of thickness.

(d1) The radius of the arcuate surfaces is from 0.7 to 1.6 mm.

If the fuel pump has one of these features or a plurality of them in combination, the pump efficiency increases, and the pump driving current is minimized. Consequently, the pump lifetime is increased.

In the fuel pump according to the present invention, the impeller has recesses repeatedly formed in the circumferential direction at a distance between each other in a region extending along the outer peripheries of the obverse and reverse sides of the impeller. The radially outer end face of each recess slantingly extends radially outward from a middle plane in the direction of thickness toward the obverse and reverse sides. Consequently, the incidence of separation or vortex formation in the flow of fuel is minimized. Accordingly, the pump efficiency is increased, and the pump driving current is minimized. Thus, the pump lifetime is increased.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1:
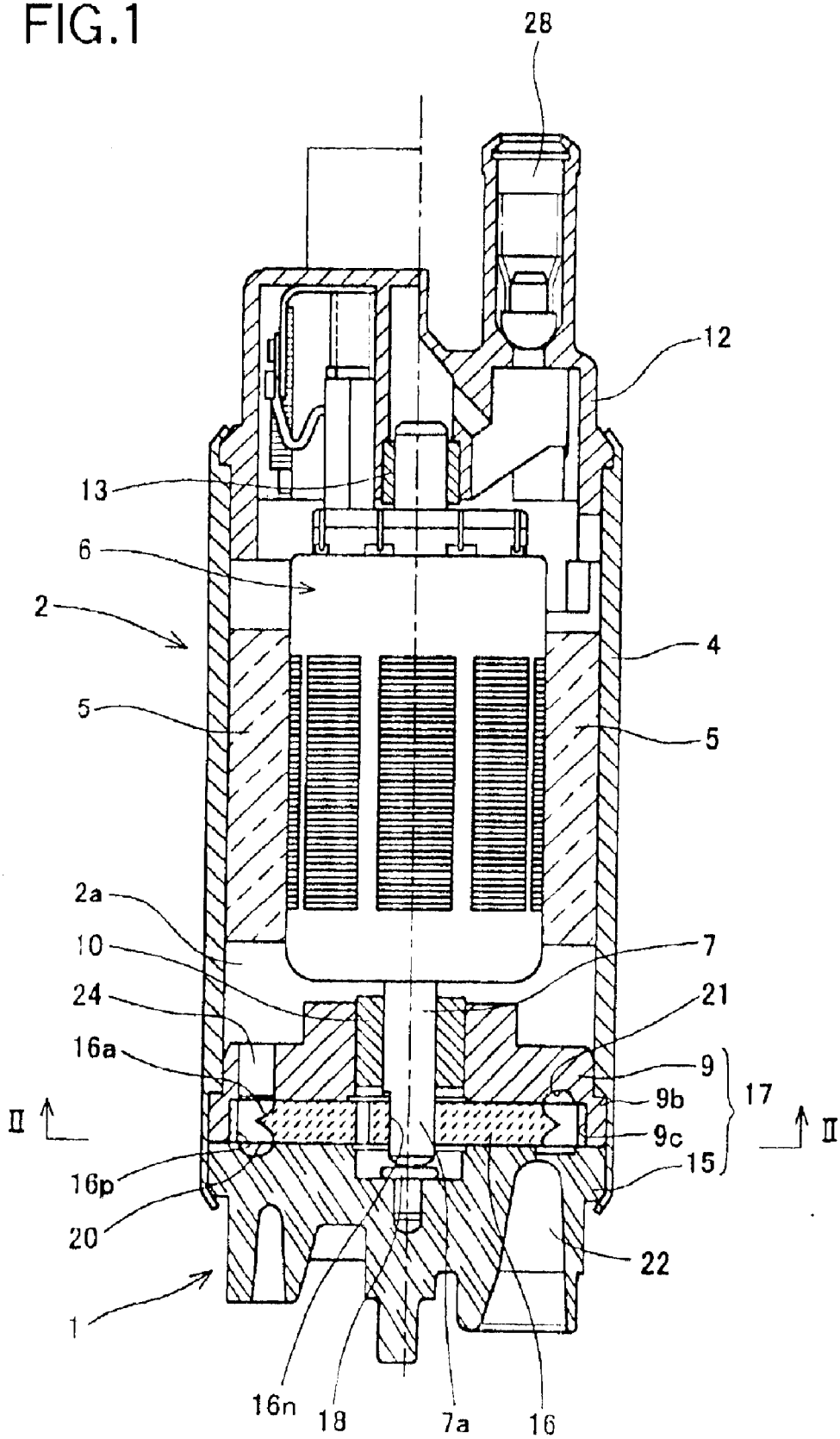
FIG. 1 is a sectional view of a fuel pump according to an embodiment of the present invention.

First, let us list useful features for improvement of the pump efficiency among those residing in embodiments of the present invention:

A. The radially inner and outer end portions of each partition are positioned on the same radius, and the radially middle portion of the partition is curved rearward in the direction of rotation of the impeller.

A1. The maximum amount of curvature of the partition is from 0.1 to 1.0 mm.

B. The partition is inclined rearward in the direction of rotation as the distance from the obverse and reverse sides increases inward in the direction of thickness. In this case, the partition should preferably be as follows.

B1: The partition should preferably be inclined at from 35° to 55° from the middle plane in the direction of thickness.

B2: In addition, the inclined partition should preferably continuously extend while defining a gently arcuate surface at the rotation direction forward side of the middle plane in the direction of thickness.

C. The thickness of the partition increases as the distance from the obverse and reverse sides increases inward in the direction of thickness.

C1: The thickness of the partition at the middle plane in the direction of thickness should preferably be greater than the thickness at the obverse and reverse sides by from 0.1 to 0.4 mm.

D. The radially inner end face of a fuel accommodating space (recess) formed between each pair of adjacent partitions has two arcuate surfaces contacting each other at the middle plane in the direction of thickness. In this case, the following is preferable:

D1: The radius of the arcuate surfaces should preferably be from 0.7 to 1.6 mm.

E. The radially outer end face of the fuel accommodating space (recess) formed between each pair of adjacent partitions slantingly extends radially outward from the middle plane in the direction of thickness toward the obverse and reverse sides. This feature is important. The present invention utilizes this feature. In this case, it is preferable that the fuel pump should further have the following features. That is, numerical conditions stated below should preferably be satisfied in order to obtain a high efficiency when the fuel pump is designed so that "the outer diameter of the impeller is from 22 to 28 mm; the radial length of each partition is from 2.9 to 4.0 mm; the circumferential distance between each pair of adjacent partitions is from 1.0 to 2.0 mm; the thickness of each partition is from 0.2 to 1.5 mm; and the thickness of the impeller is from 3.0 to 4.5 mm".

E1: The radially outer end face of each recess should preferably extend slantingly at an open angle of not more than 20° from the middle plane in the direction of thickness. Alternatively, or in addition to this feature, the following is preferable:

E2: The radially outer end face of each recess should preferably have two arcuate surfaces contacting each other at the middle plane in the direction of thickness.

E3: The radius of the arcuate surfaces should preferably be from 0.7 to 1.8 mm. With this arrangement, a high efficiency can be obtained.

A fuel pump according to an embodiment of the present invention will be described below with reference to the accompanying drawings. The fuel pump according to this embodiment is a fuel pump for use in an automobile, which is used in a fuel tank to supply fuel to the engine of the automobile.

FIG. 1 is a sectional view of the fuel pump. In the figure, the fuel pump has a pump part 1 and a motor part 2 for driving the pump part 1. The motor part 2 comprises a brush DC motor. The motor part 2 has an approximately circular cylinder-shaped pump housing 4. A magnet 5 is disposed in the pump housing 4. A rotor 6 is disposed in the pump housing 4 in concentric relation to the magnet 5.

The rotor 6 has a shaft 7. The lower end portion of the shaft 7 is rotatably supported through a bearing 10 by a pump cover 9 secured to the lower end portion of the pump housing 4. The upper end portion of the shaft 7 is rotatably supported through a bearing 13 by a motor cover 12 secured to the upper end portion of the pump housing 4.

In the motor part 2, the rotor 6 is rotated by supplying electric power to the coil (not shown) of the rotor 6 through a terminal (not shown) provided on the motor cover 12. It should be noted that the arrangement of the motor part 2 is well known. Therefore, a detailed description thereof is omitted. It should also be noted that the motor part 2 can use a motor structure other than the illustrated one.

The arrangement of the pump part 1 driven by the motor part 2 will be described below. The pump part 1 comprises a pump cover 9, a pump body 15, and an impeller 16. The pump cover 9 and the pump body 15 are formed by die casting of aluminum, for example. When combined together, the pump cover 9 and the pump body 15 constitute a pump casing 17 for accommodating the impeller 16.

Figure 2:
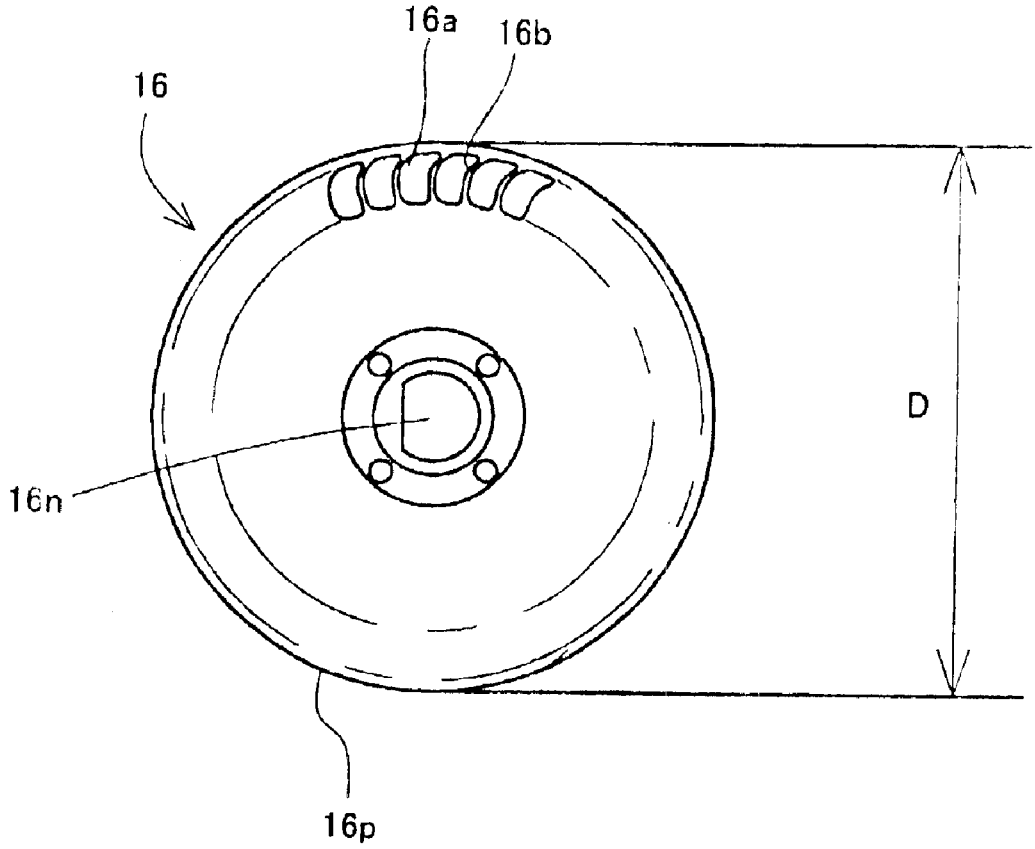
FIG. 2 is a plan view of an impeller.

The impeller 16 is formed by molding of a resin material. As shown in FIG. 2, the impeller 16 has an approximately disk-shaped configuration. A group of recesses 16*a* are formed in a region extending along the outer peripheries of the obverse and reverse sides of the disk-shaped impeller 16. The recesses 16*a* are repeatedly arranged in the circumferential direction at a distance between each pair of adjacent recesses 16*a*. The center of the impeller 16 is formed with an approximately D-shaped engagement hole 16*n*. The engagement hole 16*n* is engaged with an engagement shaft portion 7*a* with a D-shaped sectional configuration at the lower end of the shaft 7. Thus, the impeller 16 is connected to the shaft 7 so as to be rotatable simultaneously with the shaft 7 and slightly movable in the axial direction. The outer peripheral surface 16*p* of the impeller 16 is a circumferential surface.

Figure 3:
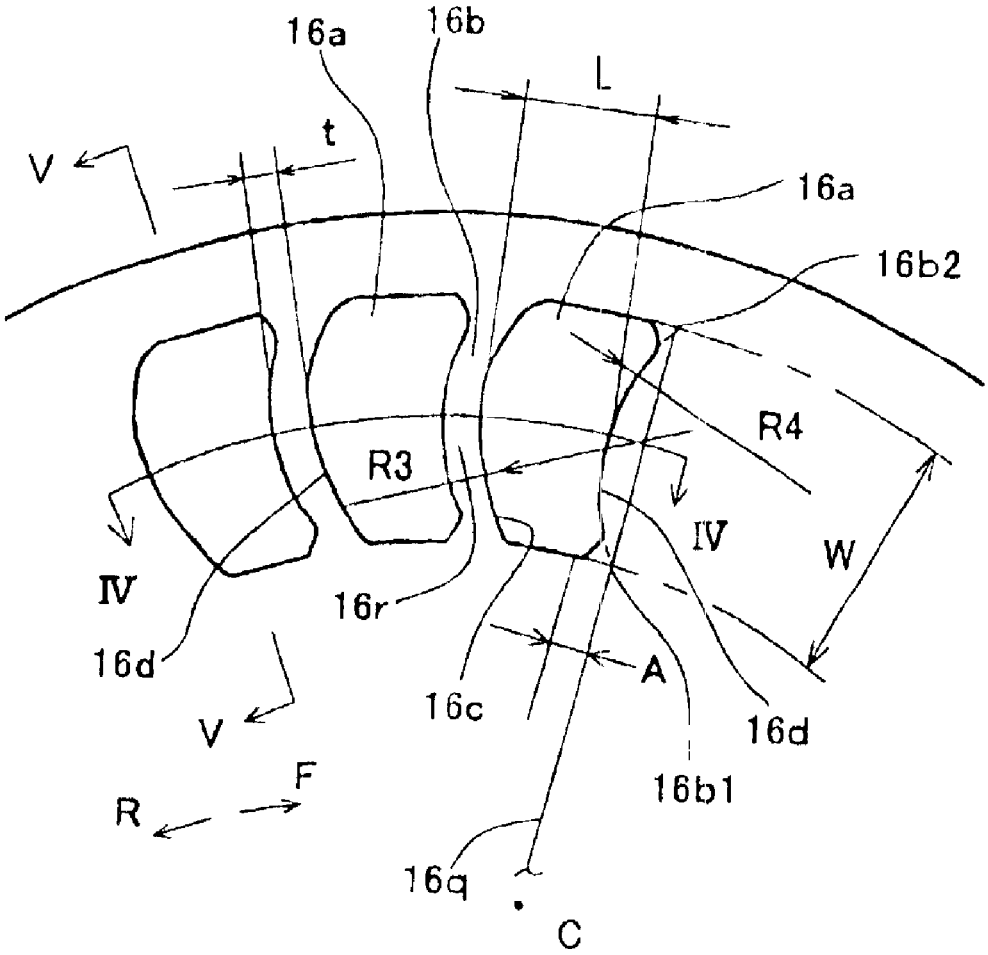
FIG. 3 is an enlarged plan view of a part of the impeller.

FIG. 3 is an enlarged view of the impeller 16. A partition 16*b* is ensured between each pair of adjacent recesses 16*a*. The impeller 16 has the following features (a) to (o):

(a) The outer diameter D of the impeller is set to from 22 to 28 mm; the radial length W of each partition is set to from 2.9 to 4.0 mm; the circumferential distance L between each pair of adjacent partitions is set to from 1.0 to 2.0 mm; the thickness t of each partition is set to from 0.2 to 1.5 mm; and the thickness T of the impeller is set to from 3.0 to 4.5 mm.

(b) The radially inner end portion 16*b*1 and the radially outer end portion 16*b*2 of the partition 16*b* are positioned on the same radius 16*q*, and the radially middle portion 16*r* of the partition 16*b* is curved rearward R in the direction of rotation of the impeller.

(c) The maximum amount of curvature A of the partition 16*b* is from 0.1 to 1.0 mm.

(d) The radius of curvature R3 forward in the direction of rotation is from 2.3 to 4.3 mm.

(e) The radius of curvature R4 rearward in the direction of rotation is from 3.0 to 5.0 mm.

Figure 4:
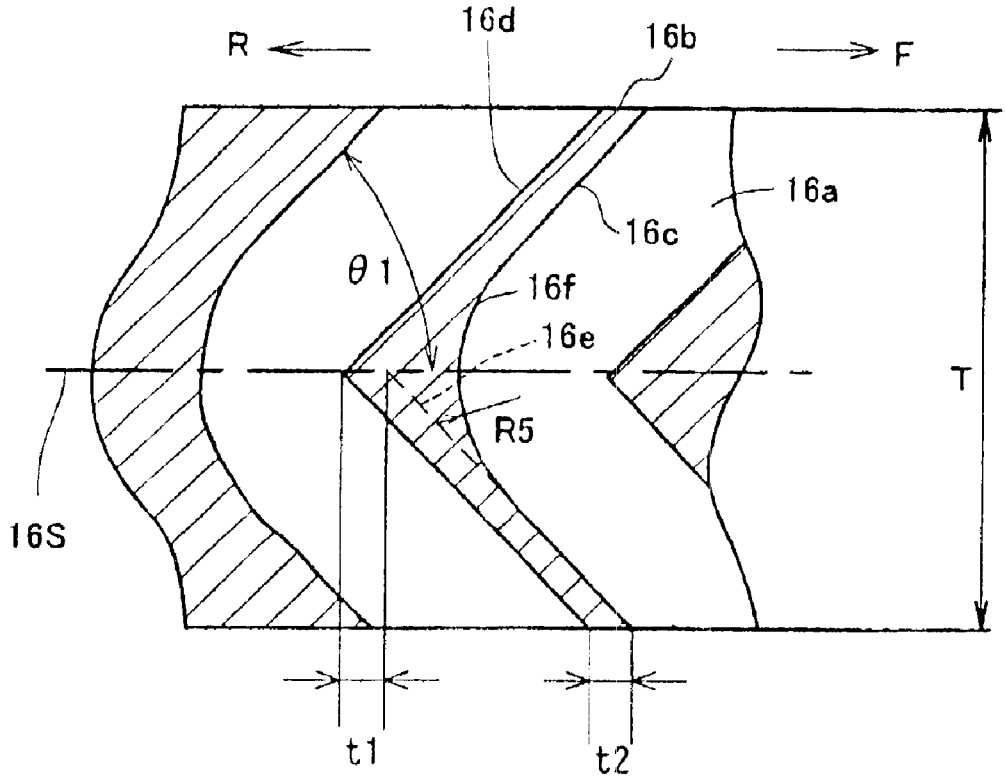
FIG. 4 is a sectional view taken along the line IV—IV in FIG. 3.

(f) As shown in FIG. 4, the partition 16*b* is inclined rearward R in the direction of rotation as the distance from the obverse and reverse sides increases inward in the direction of thickness.

(g) The angle of inclination with respect to the middle plane 16*s* in the direction of thickness is from 35° to 55°.

(h) The inclined partition 16*b* continuously extends while defining a gently arcuate surface 16*f* at the rotation direction forward side F of the middle plane 16*s* in the direction of thickness.

(i) The thickness of the partition 16*b* increases as the distance from the obverse and reverse sides increases inward in the direction of thickness. In the figure, reference symbol 16*e* denotes a surface that the partition 16*b* would have when the front surface 16*c* is not curved. Reference symbol t1 denotes the thickness of the partition 16*b* at the middle plane 16*s* in the direction of thickness. Reference symbol t2 denotes the thickness of the partition 16*b* at the obverse and reverse sides. t1 is greater than t2. t1−t2 is from 0.1 to 0.4 mm.

Figure 5:
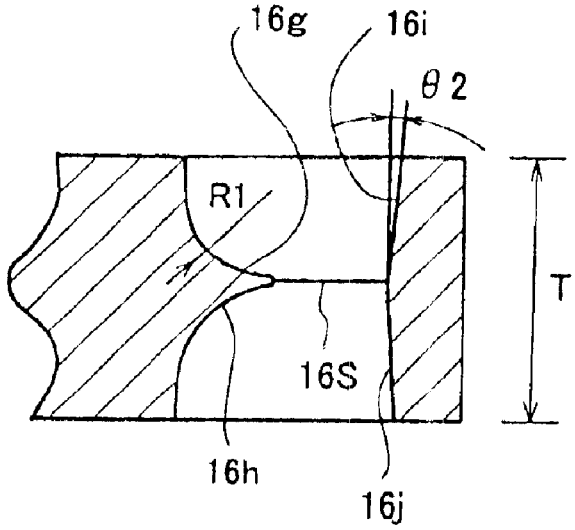
FIG. 5 is a sectional view taken along the line V—V in FIG. 3.

(j) As shown in FIG. 5, the radially inner end face of a fuel accommodating space 16*a* (recess) formed between each pair of adjacent partitions 16*b* has two arcuate surfaces 16*g* and 16*h* contacting each other at the middle plane 16*s* in the direction of thickness.

(k) The radius R1 of the arcuate surfaces 16*g* and 16*h* is from 0.7 to 1.6 mm.

(l) As shown in FIG. 5, the radially outer end face 16*i* (16*j*) of the fuel accommodating space 16*a* (recess) formed between each pair of adjacent partitions 16*b* slantingly extends radially outward from the middle plane 16*s* in the direction of thickness toward the obverse and reverse sides. The radially outer side of the recess 16*a* is closed by the end face 16*i* (16*j*).

Figure 6:
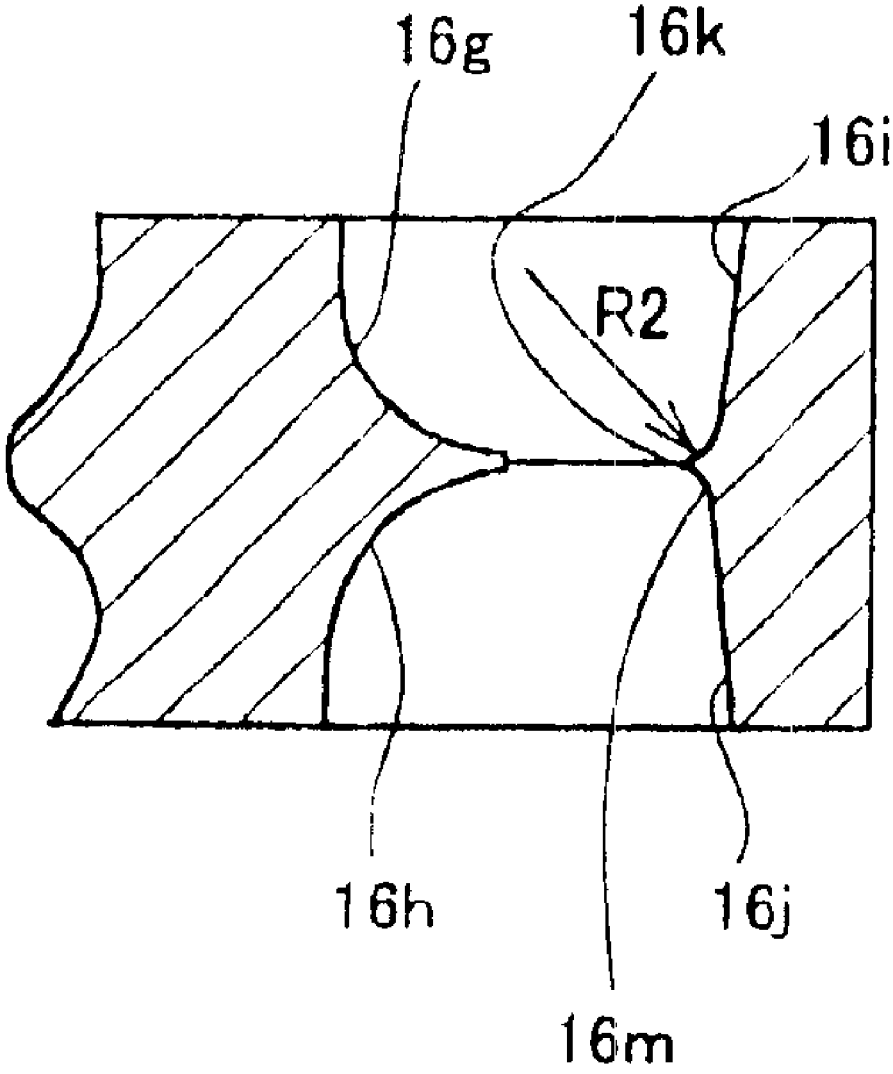
FIG. 6 is a diagram corresponding to FIG. 5, showing a second embodiment of the present invention.

(m) The open angle of the radially outer end face of each recess is not more than 20°. Alternatively, as shown in FIG. 6, which shows a second embodiment of the present invention, the radially outer end face 16*i* (16*j*) of each fuel accommodating space 16*a* (recess) may be arranged as follows.

(n) The radially outer end face 16*i* (16*j*) has two arcuate surfaces 16*k* and 16*m* contacting each other at the middle plane 16*s* in the direction of thickness.

(o) The radius of the arcuate surfaces 16*k* and 16*m* is from 0.7 to 1.8 mm.

As shown in FIG. 1, the pump cover 9 has a circumferentially extending recess 21 for forming a circumferentially extending flow passage groove between the same and the group of recesses 16*a* of the impeller 16. The pump cover 9 further has a discharge opening 24 communicating with the downstream end of the recess 21. Further, the pump cover 9 has a circumferential wall 9*b*. As shown in FIG. 1, the discharge opening 24 extends through the pump cover 9 to communicate with a space 2*a* in the motor part 2. The inner peripheral surface 9*c* of the circumferential wall 9*b* faces the outer peripheral surface 16*p* of the impeller 16 across a clearance.

The pump body 15 is laid on the pump cover 9. In this state, the pump body 15 is secured to the lower end portion of the pump housing 4 by caulking or the like. A thrust bearing 18 is secured to the impeller-side surface of a central portion of the pump body 15. The thrust bearing 18 bears the thrust load of the shaft 7. The pump cover 9 and the pump body 15 constitute a pump casing 17. The impeller 16 is accommodated in the pump casing 17 so as to be rotatable and slightly movable in the axial direction. The inner surface of the pump body 15 is formed with a circumferentially extending recess 20 for forming a circumferentially extending flow passage groove between the same and the group of recesses 16*a* of the impeller 16. The pump body 15 further has a suction opening 22 communicating with the upstream end of the recess 20.

The circumferentially extending recess 21 of the pump cover 9 and the circumferentially extending recess 20 of the pump body 15 extend along the rotation direction of the impeller 16 from a position corresponding to the suction opening 22 on the pump body 15 to a position corresponding to the discharge opening 24 on the pump cover 9 to form a flow passage groove extending circumferentially from the suction opening 22 to the discharge opening 24. When the impeller 16 rotates in the direction F, fuel is sucked into the flow passage groove from the suction opening 22. While flowing through the flow passage groove from the suction opening 22 to the discharge opening 24, the fuel is pressurized, and the pressurized fuel is delivered to the motor part 2 from the discharge opening 24. Neither of the recesses 21 and 20 are formed in an area extending in the rotation direction of the impeller 16 from a position corresponding to the discharge opening 24 on the pump cover 9 to a position corresponding to the suction opening 22 on the pump body 15, thereby preventing the pressurized fuel from returning to the suction opening 22 side as much as possible. It should be noted that the high-pressure fuel delivered to the motor part 2 is delivered to the outside of the pump from a delivery opening 28.

The fuel pump according to this embodiment has both the qualitative and quantitative features as stated above and hence exhibits a high pump efficiency. The same pump capacity as that conventionally obtained by supplying a motor current of 2.2 amps can be realized with a motor current of 1.5 amps.

What is claimed is:

1. A fuel pump having an impeller rotating in a pump casing, said impeller having an approximately disk-shaped configuration with a group of recesses formed in a region extending along outer peripheries of obverse and reverse sides of said impeller, said recesses being repeatedly arranged in a circumferential direction with a partition provided between each pair of adjacent recesses, wherein a radially outer end face of each of said recesses slantingly extends radially outward from a middle plane in a direction of thickness toward the obverse and reverse sides and a radially middle portion of said partition is curved rearward in a direction of rotation of the impeller.

2. A fuel pump according to claim 1, wherein a diameter of the impeller is from 22 to 28 mm; a radial length of each partition is from 2.9 to 4.0 mm; a circumferential distance between each pair of adjacent partitions is from 1.0 to 2.0 mm; a thickness of each partition is from 0.2 to 1.5 mm; a thickness of the impeller is from 3.0 to 4.5 mm, and the radially outer end face of each of said recesses slantingly extends radially outward at an open angle of not more than 20° from the middle plane in the direction of thickness.

3. A fuel pump according to claim 1, wherein a diameter of the impeller is from 22 to 28 mm; a radial length of each partition is from 2.9 to 4.0 mm; a circumferential distance between each pair of adjacent partitions is from 1.0 to 2.0 mm; a thickness of each partition is from 0.2 to 1.5 mm; a thickness of the impeller is from 3.0 to 4.5 mm, and the radially outer end face of each of said recesses has two arcuate surfaces contacting each other at the middle plane in the direction of thickness.

4. A fuel pump according to claim 3, wherein a radius of said arcuate surfaces is from 0.7 to 1.8 mm.

5. A fuel pump according to claim 1, wherein radially inner and outer end portions of said partition are positioned on a same radius.

6. A fuel pump according to claim 5, wherein a maximum amount of curvature of said partition is from 0.1 to 1.0 mm.

7. A fuel pump according to claim 1, wherein said partition is inclined rearward in a direction of rotation as a distance from the obverse and reverse sides increases inward in the direction of thickness.

8. A fuel pump according to claim 7, wherein said partition is inclined at from 35° to 55° from the middle plane in the direction of thickness.

9. A fuel pump according to claim 7, wherein said partition continuously extends while defining a gently arcuate surface at a rotation direction forward side of the middle plane in the direction of thickness.

10. A fuel pump according to claim 1, wherein a thickness of said partition increases as a distance from the obverse and reverse sides increases inward in the direction of thickness.

11. A fuel pump according to claim 10, wherein the thickness of said partition at the middle plane in the direction of thickness is greater than a thickness thereof at the obverse and reverse sides by from 0.1 to 0.4 mm.

12. A fuel pump according to claim 1, wherein a radially inner end face of each of said recesses has two arcuate surfaces contacting each other at the middle plane in the direction of thickness.

13. A fuel pump according to claim 12, wherein a radius of the arcuate surfaces is from 0.7 to 1.6 mm.

14. A fuel pump according to claim 1, wherein the radially outer end face of each of said recesses has two arcuate surfaces contacting each other at the middle plane in the direction of thickness; radially inner and outer end portions of said partition are positioned on a same radius.

* * * * *